US005775438A

United States Patent [19]

Confoey et al.

[11] Patent Number: 5,775,438

[45] Date of Patent: Jul. 7, 1998

[54] EARTH WORKING SCRAPER APPARATUS

[76] Inventors: Richard J. Confoey, 15846 Heiser Rd., Berlin Center, Ohio 44401-9721; Donald W. Akins, 38159 Dodd's Hill, Willoughby Hills, Ohio 44094

[21] Appl. No.: 873,151

[22] Filed: Jun. 11, 1997

[51] Int. Cl.[6] ..... E02F 3/76

[52] U.S. Cl. ..... 172/831; 172/811

[58] Field of Search ..... 172/811, 810, 172/828, 831, 830

[56] References Cited

U.S. PATENT DOCUMENTS

| | | | |
|---|---|---|---|
| 2,219,159 | 10/1940 | Flynn et al. . | |
| 2,336,124 | 12/1943 | Phoenix . | |
| 2,615,262 | 10/1952 | Reid, Sr. . | |
| 3,097,439 | 7/1963 | Calkin . | |
| 3,548,956 | 12/1970 | Hochstetler . | |
| 4,119,225 | 10/1978 | Macht et al. . | |
| 4,422,818 | 12/1983 | Molby . | |
| 4,635,730 | 1/1987 | Larsson . | |
| 4,698,150 | 10/1987 | Wigoda | 172/811 X |
| 4,809,449 | 3/1989 | Solaja . | |
| 4,940,096 | 7/1990 | Johnson | 172/810 X |
| 4,942,934 | 7/1990 | Moriarty . | |
| 5,127,172 | 7/1992 | Lund et al. . | |
| 5,181,574 | 1/1993 | Dion . | |
| 5,392,864 | 2/1995 | Lindenmuth | 172/811 |
| 5,697,731 | 12/1997 | Bonds | 172/828 X |
| 5,701,693 | 12/1997 | Brocious et al. . | |

FOREIGN PATENT DOCUMENTS

| | | | |
|---|---|---|---|
| 3340470 | 5/1985 | Germany | 172/811 |

OTHER PUBLICATIONS

Bobcat Brochure entitled: "Attachments for Loaders"; B-1595; (Melroe #6724297).

*Primary Examiner*—Michael J. Carone
*Assistant Examiner*—Christopher J. Novosad
*Attorney, Agent, or Firm*—Robert J. Herberger, Esquire

[57] ABSTRACT

A front-end mounted earth working apparatus for a vehicle, including a skid steer, forms the subject of this invention. The earth working apparatus has a guide frame portion and grading portion. The guide frame portion is attached to the skid steer by a mounting plate. The mounting plate has a lifting fork extending forward therefrom being substantially horizontal. The grading portion is suspended below the guide frame portion by the lifting fork using a suspension mechanism. The grading portion being substantially parallel to the lifting fork. The grading portion further having front and rear blades attached to side rails. The rear blades being attached below the side rails by being pivotably hinged at one end and selectively secured to a corresponding adjustment plate so that the angle of each rear blade is adjustable.

18 Claims, 7 Drawing Sheets

EARTH WORKING SCRAPER APPARATUS

FIELD OF THE INVENTION

This invention relates to an earth working apparatus for landscaping, leveling, finish grading, cutting and spreading dirt, sand, gravel and the like. More particularly, this invention relates to earth working equipment having a grader portion suspended from a guide frame.

BACKGROUND OF THE INVENTION

Various earth working equipment are available having different size blades extending in various configurations. Typically, they are made to fit on the front or back end of bulldozers or tractors and are used to either scrape ground debris or to grade the ground, exclusively. Their applications have been limited and their range of motion restricted.

For example, the invention illustrated and described in U.S. Pat. No. 2,219,159 focuses on moldboards or blades for mounting on the front end of tractors and road graders which can be a forward V-shape blade, a reversed V-shape blade, and a straight grading blade all combined in one main blade. This type of earth working equipment utilizes the different blade configurations to scrape brush and other such debris from the ground.

A disadvantage noted in this type of earth working equipment is that it is limited in its range of motion. The connection of the blade to the bulldozer allows for only forward movement, which greatly reduces the applications of the earth working equipment. Further, due to the rigid connection of the bucket to the blade, the bucket must be constantly raised and lowered when traversing uncleared ground. This results in wasted time, increased wear and tear on the underside of the machine and operator fatigue.

One solution to this problem has been to provide a method in which the blade is pivotally connected to the frame of a compacting vehicle as shown in U.S. Pat. No. 5,392,864. This invention provides a method of directing the debris away from the wheels of the machine when the blade is in the raised position. However, this invention still necessitates the raising and lowering of the blade when traveling across uneven land.

It would therefore be desirable to have a way to move over rugged ground without requiring the operator to raise and lower the blade as land irregularities are approached. A general object of this invention, then, is to provide an earth working apparatus that has a grading portion suspended from a guide frame portion by the lifting fork using a suspension mechanism. The suspension mechanism allows for self adjustment of the blades when traveling over bumps or valleys, thereby eliminating the need for the operator to repeatedly raise and lower the blade. A more specific object of this invention is to provide an earth working apparatus that meets the aforementioned goals, has a wide range of motion and that allows for a full forward view for the operator. By being designed to fit on the front of a skid steer, tractor, forklift, front-end loader, or the like, the movement capabilities are increased to forwards, backwards, sidewards, upwards and downwards.

This invention is also novel in its use of adjustable rear blades that are connected to the earth working apparatus by a pivoting hinge. Further, this invention makes use of a T-bracket attached parallel to each side rail which prevents the guide frame portion and grading portion from separating vertically a distance sufficient to cause the suspension mechanism to buckle or otherwise bind. The front and rear blades can be used either conjunctively or exclusively, performing even more land moving and leveling functions.

SUMMARY OF THE INVENTION

The state-of-the-art for farming, construction and land moving vehicles has been improved with the replacement of tractors and forklifts with skid steers. Well known skid steers include brand names such as "BOBCAT®" and "CASE 1800 SERIES". The trademark "BOBCAT®" is owned by owned by the Clark Equipment Company which is a subsidiary of Ingersoll-Rand Company. The Ingersoll-Rand Company has its' principal place of business located in Woodcliff Lake, N.J. Further, "BOBCAT®" skid steers are manufactured in Fargo, N. Dak., through the Melroe Division of the Ingersoll-Rand Company. The "CASE 1800 SERIES" are manufactured by Case Corporation having its principal place of business located at Racine, Wis. Skid steers give the operator more versatility in that the vehicle is more easily controlled frontwards, backwards, up, down and to the sides. Attachments for skid steers are designed primarily to be mounted on the front.

In one aspect of the present invention, an earth working apparatus is provided which attaches to the lift arms of a skid steer. It includes a guide frame portion and a grader portion suspended therefrom. At the opposite end of each lifting arm are suspension mechanisms suspending the grader portion in substantially parallel spaced relation with the guide frame portion.

Another aspect of the present invention includes adjustable rear blades attached to adjustment plates. In the outermost perimeter of each adjustment plate are a plurality of positioning holes with which to adjust the angle of the rear blades.

BRIEF DESCRIPTION OF THE DRAWINGS

Thirteen (13) figures have been selected to illustrate a preferred embodiment of the present invention. These figures along with the accompanying description are sufficient for those skilled in the art to practice the invention as claimed. Included are:

DETAILED DESCRIPTION

Figure 1:
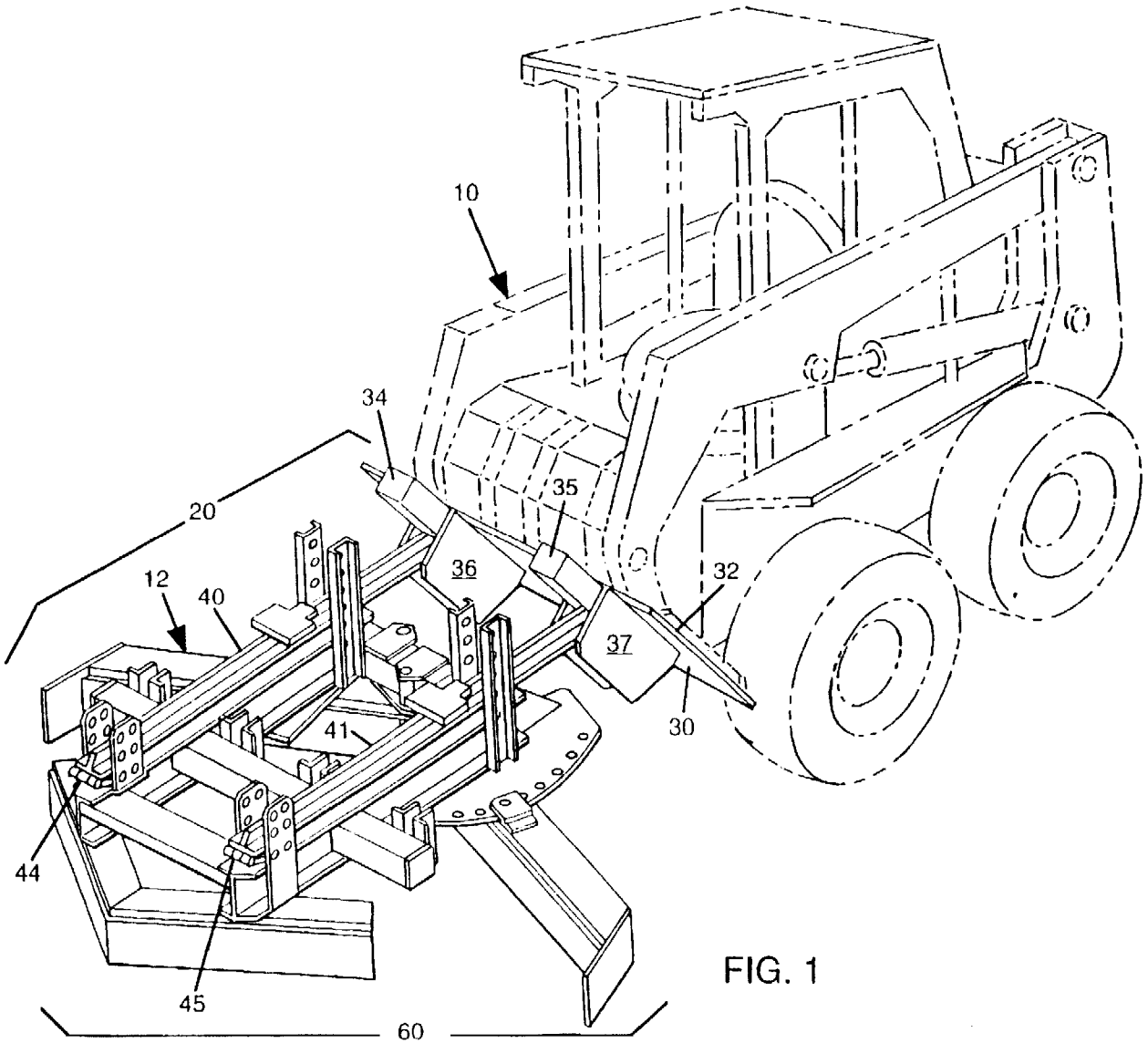
FIG. 1 showing a perspective view of the earth working apparatus attached to a skid steer.

With reference now to the details of the above described drawings, the earth working apparatus 12 shown in FIG. 1 is attached to the lift arms of a skid steer 10. The earth working apparatus 12 comprises a guide frame portion 20 and grader portion 60 suspended therefrom. The guide frame portion 20 has a mounting plate 30 with a mounting face 32. The mounting face 32 abuts flush with the lift arm bracket of the skid steer 10 so that mounting plate 30 may be removably attached to the lift arm bracket of the skid steer 10 as is well known in the art.

Figure 9:
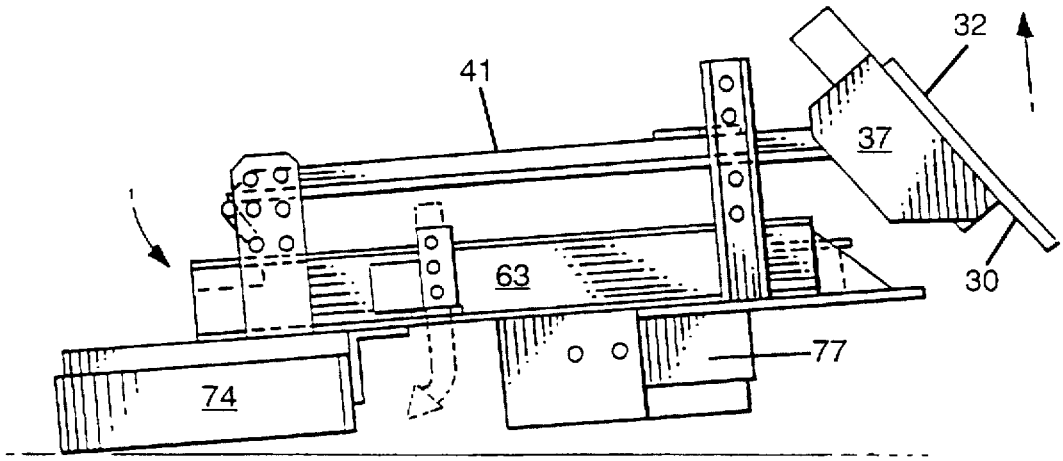
FIG. 9 is a side view showing the apparatus tilted nose down so that the V-shaped front blade can be used to shape a ditch or swale.
Figure 10:
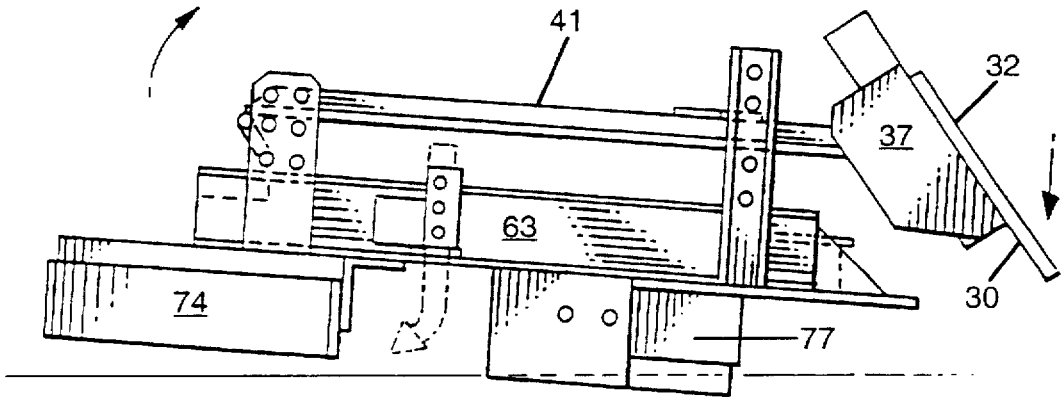
FIG. 10 is a side view showing the apparatus tilted down at the rear blades lifting the V-shaped front blade.

The mounting plate 30 is angled from the vertical position at between 20° to 45°, with the preferred angle being 35°, thereby allowing the lift arms of the skid steer 10 to maneuver the earth working apparatus 12 by lifting and rotating the earth working apparatus 12 from the horizontal position as depicted in FIGS. 9 and 10. Referring back to FIG. 1, on the opposite side of the mounting face 32 of mounting plate 30 is attached a pair of mounting support members 34 and 35 in spaced parallel relationship. Attached to each mounting support member 34 and 35 is attached a pair of mounting brackets 36 and 37, respectively. The mounting brackets 36 and 37 are also attached to mounting plate 30 to provide structural support to the mounting plate 30 within guide frame portion 20.

Figure 2:
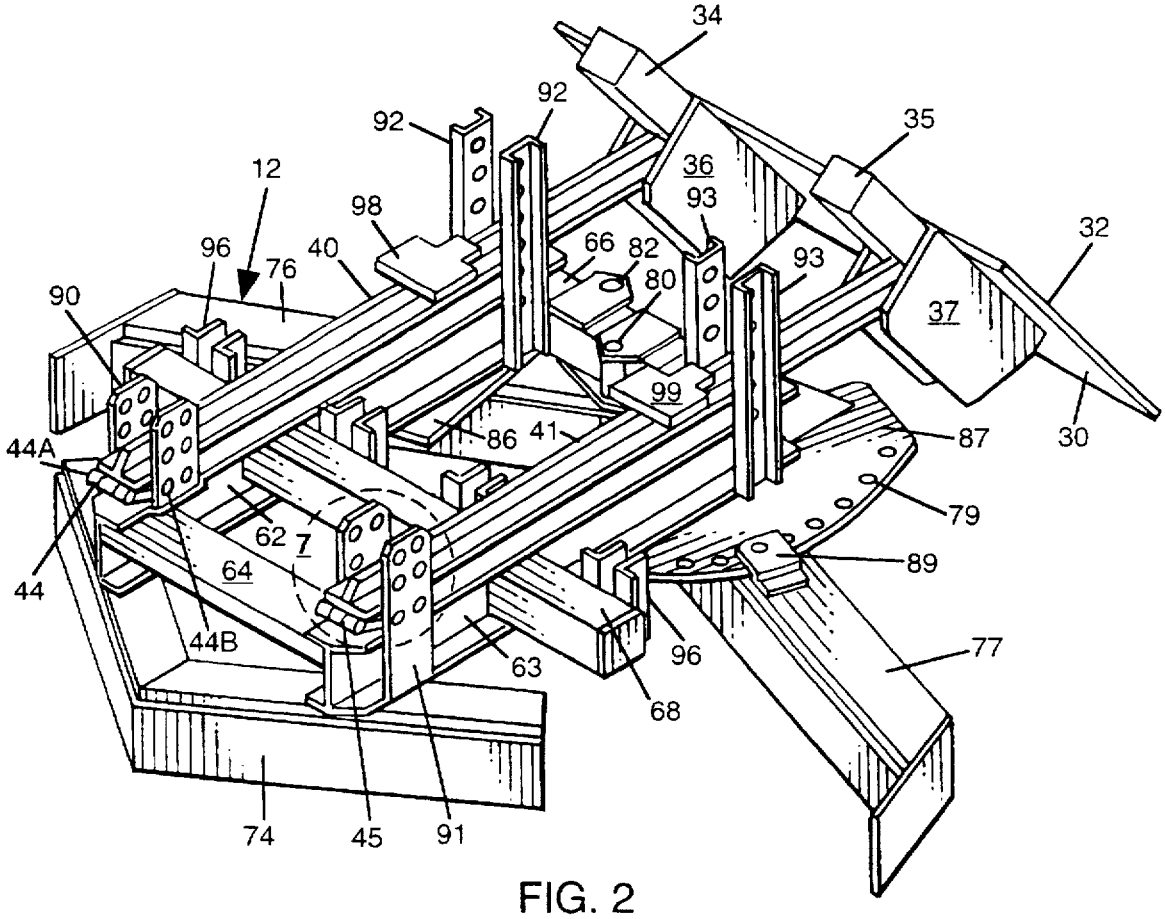
FIG. 2 showing a perspective view of the earth working apparatus.
Figure 3:
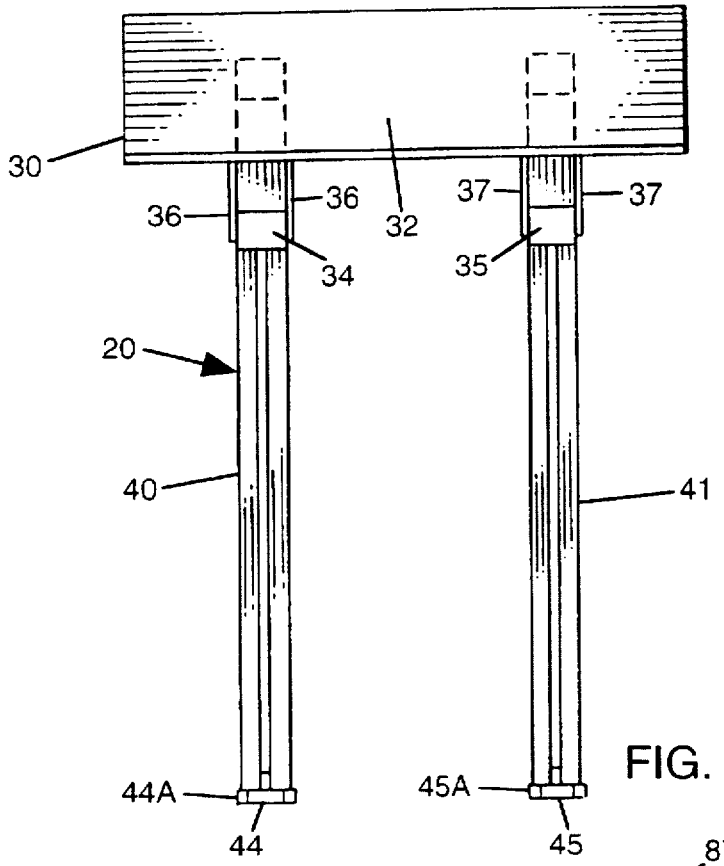
FIG. 3 showing a top plan view of the earth working apparatus.
Figure 7:
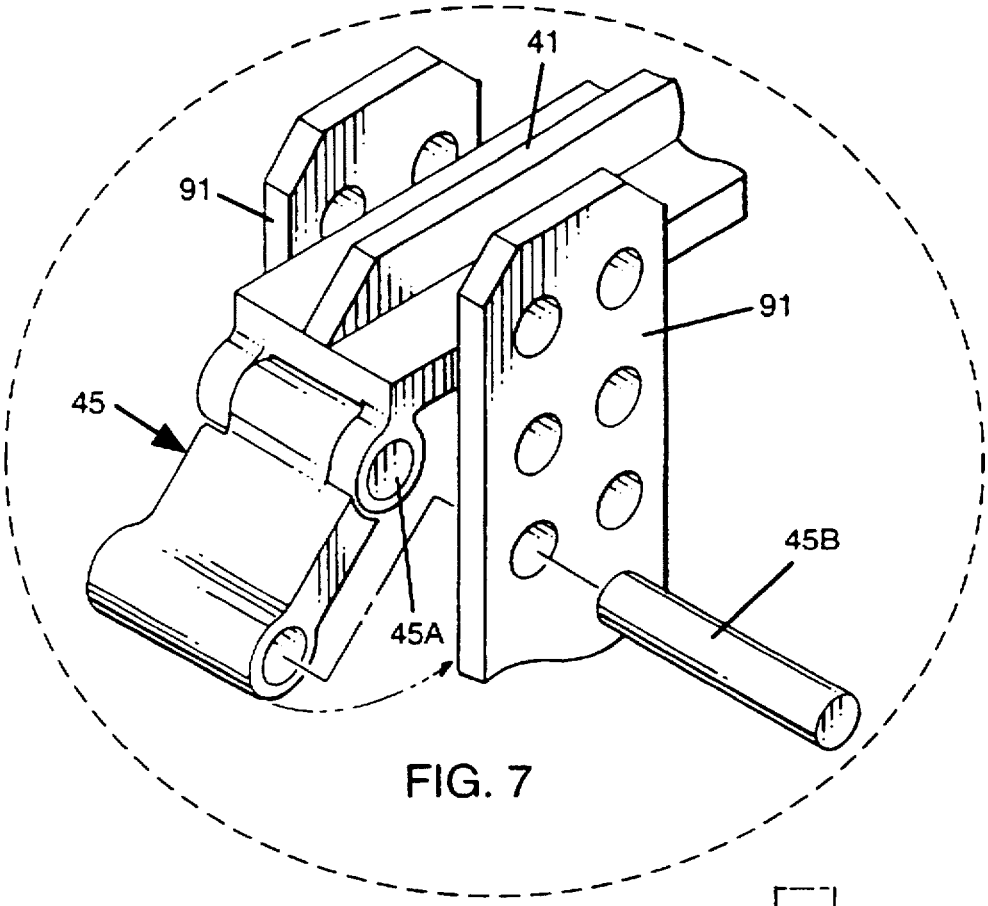
FIG. 7 is an enlarged partial exploded view of the suspension mechanism, as seen in detail -7 of FIG. 2.

Viewing FIG. 3 from the perspective of the skid steer operator, right and left lifting forks 40 and 41 extend in parallel spaced relationship and being substantially horizontal. Each lifting fork 40 and 41 is attached at one end to the corresponding mounting support member 34 and 35 between respective mounting brackets 36 and 37. At the opposite end of each lifting fork 40 and 41 is a suspension mechanism suspending the grader portion 60 therefrom in substantially parallel spaced relation with guide frame portion 20. The suspension mechanism may comprise a chain, spring, shock absorber, hydraulic or pneumatic cylinder, hinge mechanism or similar device. The preferred embodiment is a hinge mechanism as shown in FIGS. 2 and 7 as elements 44 and 45. Focusing on the exploded view of hinge mechanism 45 shown in FIG. 7, each hinge mechanism is pivotally attached from the forward end of the respective lifting fork to the corresponding front end guide bracket by attachment pins. More particularly, hinge 45 is pivotally attached from the forward end of lifting fork 41 and front end guide bracket 91 by attachment hinge pins 45A and 45B. In like fashion, hinge 44 is pivotally attached from the forward end of lifting fork 40 and front end guide bracket 90 by attachment hinge pins 44A and 44B, respectively. While hinge pins 44A and 45A are generally fixed to lifting forks 40 and 41, hinge pins 44B and 45B may be selectively attached in any one of six hole positions in front end guide brackets 90 and 91.

Figure 4:
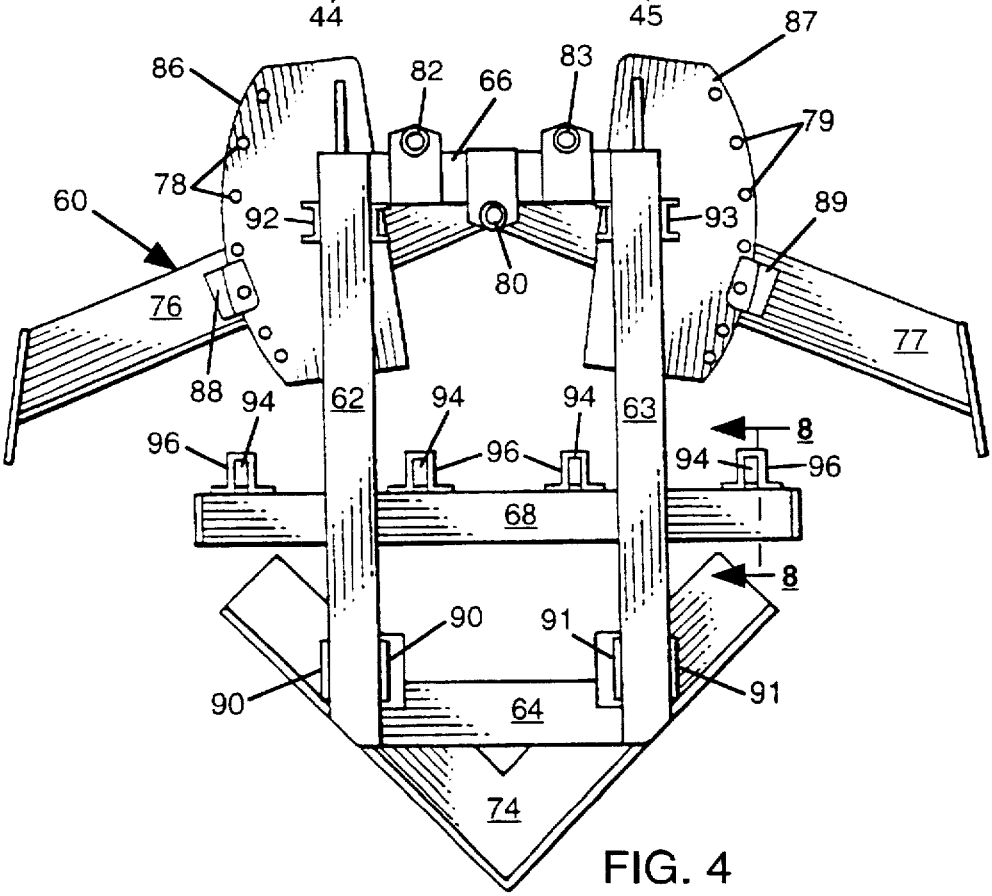
FIG. 4 showing a top plan view of the grader portion of the earth working apparatus.

Viewing FIG. 4, the grader portion 60 has right and left side rails 62 and 63. Side rails 62 and 63 being in substantially parallel relation. The distance between the right and left side rail 62 and 63 respectively, being equal to the distance between right and left lifting forks 40 and 41, so that side rail 62 is in vertical alignment with right lifting fork 40 and side rail 63 is in vertical alignment with left lifting fork 41. Front and back cross members 64 and 66, respective, attach right and left side rails 62 and 63.

Figure 11A:
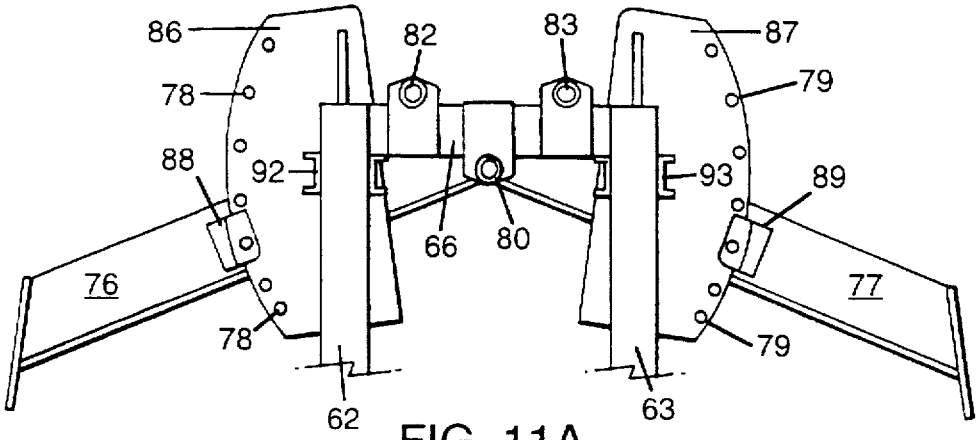
FIGS. 11A and 11B show partial plan views of the rear blades attached from the center pivot hinge to the adjustment plates at different angles.
Figure 11B:
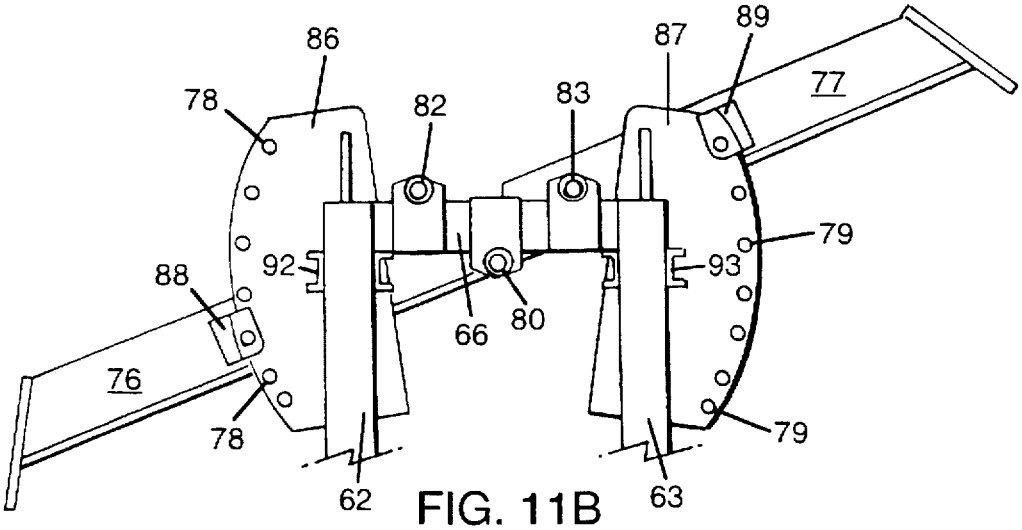
Figure 11C:
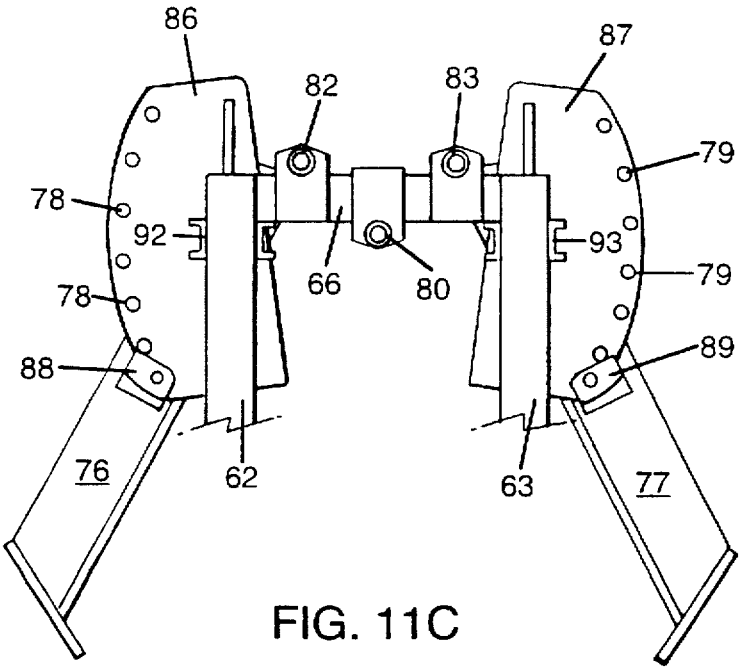
FIG. 11C is a partial plan view of the rear blades attached from the right and left pivot hinges to the corresponding adjustment plates thereby providing a gap between the rear blades.

Attached to the front cross member 64 below side rails 62 and 63 is a V-shaped cutting blade 74 with the apex of the V-shape in the forward-most position of the earth working apparatus 12, as best seen in FIGS. 2 and 4. Attached to the back cross member 66 are a pair of rear blades 76 and 77. One end of each rear blade 76 and 77 is pivotally attached to the back cross member 66 by rear blade hinge 80 or 82 and 83 connected to the back cross member 66. Viewing FIGS. 11A, 11B and 11C, rear blade 76 may be selectively attached through center hinge 80 or right hinge 82, while rear blade 77 may be selectively attached through center hinge 80 or left hinge 83. Where rear blades 76 and 77 are attached through right and left hinges 82 and 83 respectively, a gap is provided between the inwardly mounted ends of blades 76 and 77, so that dirt can be funneled therethrough to fill lower areas such as a trench, ditch or hole, forming a windrow with the excess dirt.

Rear blades 76 and 77 are adjustably secured in position to adjustment plates 86 and 87. Adjustment plate 86 is attached below right side rail 62 and adjustment plate 87 is attached below left side rail 63. In the outermost perimeter of each adjustment plate 86 and 87 are a plurality of positioning holes 78 and 79. Adjustment pin blocks 88 and 89 are attached to rear blades 76 and 77, respectively, providing a gap between the rear blade and the corresponding mounting block for the adjustment plate to slide freely therebetween. For each adjustment plate 86 and 87 there is a hole for registrational alignment with one of the plurality of positioning holes 78 or 79 in the corresponding adjustment plate 86 and 87. Rear blade 76 may be arranged at various angles by rotating the rear blade 76 about the corresponding pivoting hinge 80 or 82 and securing the rear blade 76 to adjustment plate 86 using a locking pin. In like fashion, rear blade 77 may be configured by rotating rear blade 77 about the corresponding pivoting hinge 80 or 83 and securing the rear blade 77 to adjustment plate 87 also using a locking pin.

Figure 5:
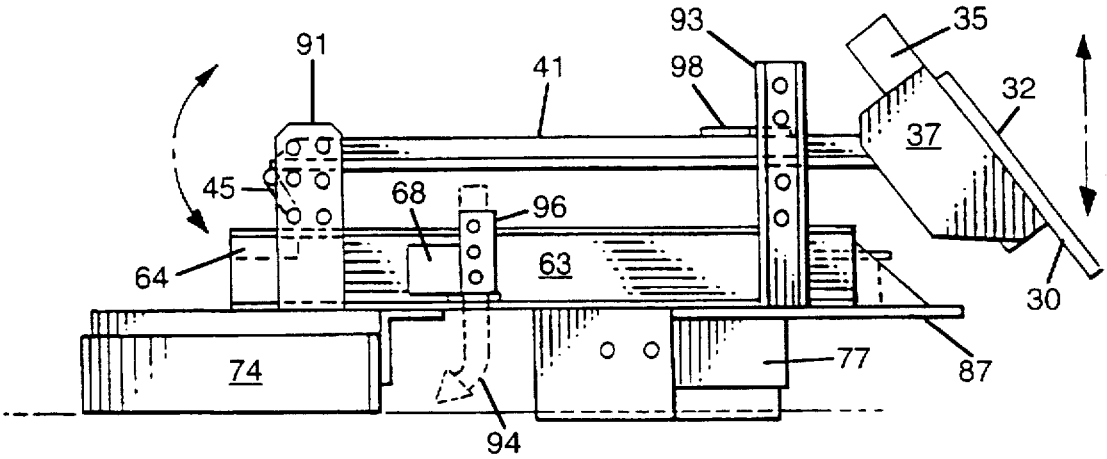
FIG. 5 showing an elevational view of a side of the earth working apparatus.

In the illustrated embodiment of the grader portion 60 of the invention, rear blades 76 and 77 lie in a common horizontal plane slightly lower than the horizontal plane formed by the V-shaped cutting blade 74. The difference in height between the V-shaped cutting blade 74 and rear blades 76 and 77 is the thickness of adjustment plates 86 and 87 which is preferably about 0.5 inch thick. This allows the V-shaped cutting blade 74 to be slightly higher than rear blades 76 and 77 as best seen in FIG. 5.

Figure 8:
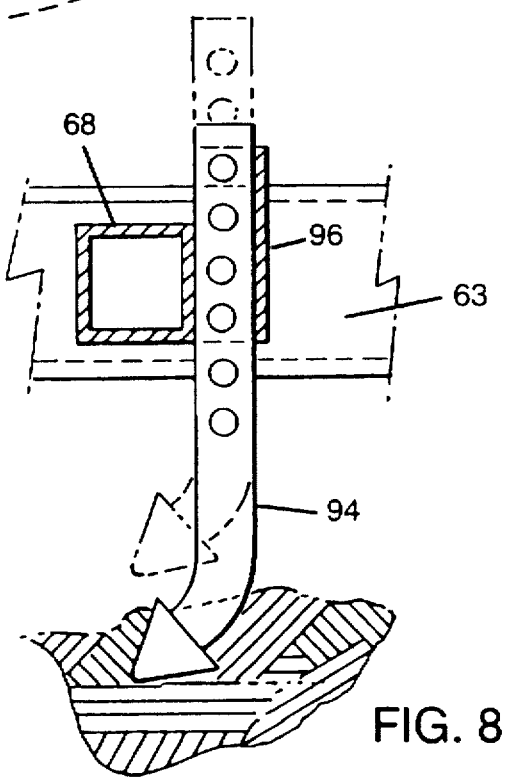
FIG. 8 is an enlarged sectional detail of the scarfier suspension, as seen in the broken line 8—8 of FIG. 4.

Between rear blades 76 and 77 and the V-shaped cutting blade 74 is mounted a center cross-member 68 traversing right and left side rails 62 and 63. Secured on the center cross-member 68 are at least four adjustable scarifiers 94 removably attached by scarifier brackets 96 as best illustrated in FIGS. 4 and 8.

Figure 6:
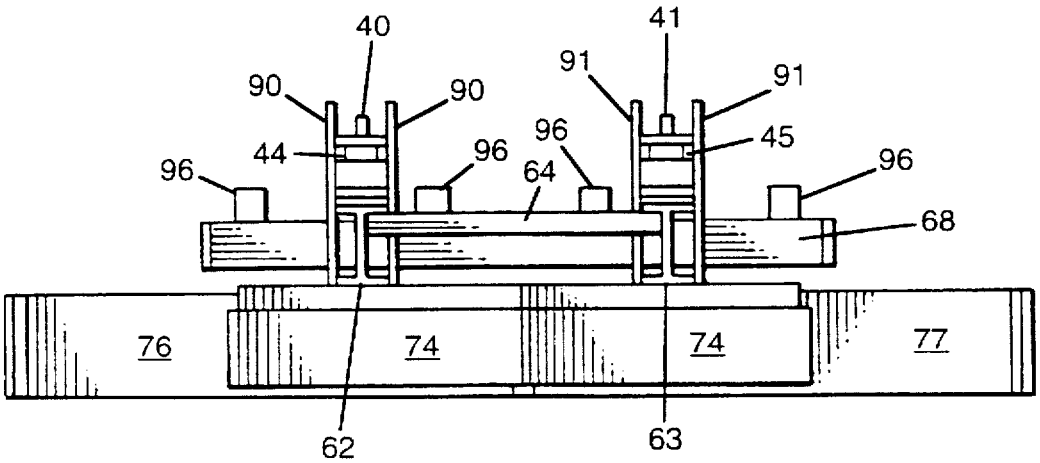
FIG. 6 showing a front elevational view of the earth working apparatus.

As previously stated, guide frame portion 20 is attached to grader portion 60 by a suspension mechanism, preferably including a pair of hinge mechanisms 44 and 45 suspended therebetween. Hinge mechanisms 44 and 45 extending from the frontmost end of right and left lifting forks 40 and 41 to the corresponding right and left side rail 62 and 63 between and attached to front-end guide brackets 90 and 91, as previously described. Each front-end guide bracket 90 and 91 comprises a pair of plates mounted to the sides of the front-end of corresponding right and left side rail 62 and 63 so that right and left lifting forks 40 and 41 fit therebetween, as best seen in FIGS. 2 and 6. The front-end guide brackets 90 and 91 help to prevent lateral movement between the front of the guide frame portion 20 and the front of the grader portion 60.

In like fashion, a pair of back-end guide brackets 92 and 93, which can be best seen in FIG. 2, are mounted to the sides of the corresponding side rail 62 and 63 providing additional lateral support between the guide frame portion 20 and grader portion 60. In addition, a pair of T-brackets 98 and 99 are mounted on top of each lifting fork 40 and 41 in front of the back-end guide brackets 92 and 93 to prevent the lifting forks 40 and 41 from vertically separating from side rails 62 and 63 a distance greater than the length of the suspension mechanism. To illustrate, assume that the suspension mechanism is the preferred hinges 44 and 45 attached by attachment pins 44A, 44B, 45A and 45B with each hinge mechanism having an overall length of 4 inches between the respective attachment pins. If lifting forks 40 and 41 separate from side rails 62 and 63 by 4 inches, the hinge would be substantially perpendicular therebetween which may cause the hinge to buckle or otherwise bind. Therefore, the T-brackets 98 and 99 are mounted on each lifting fork 40 and 41 so that the T-brackets 98 and 99 contact the corresponding back-end guide brackets 92 and 93 before the side rails 62 and 63 extend 4 inches from the lifting forks 40 and 41.

In operation, skid steer 10 travels with the guide frame portion 20 of the earth working apparatus 12 attached to the lift arms of a skid steer 10. With the grader portion 60 suspended from guide frame portion 20 by suspension mechanism 44 and 45, the grader portion 60 slides across the topography of the ground thereby allowing vertical movement of the grader portion 60 from guide frame portion 20. Using pins through the front and back end guide brackets 90, 91, 92 and 93 an operator may restrict the vertical movement of the grader portion 60 and guide frame portion 20 to the extent that there is no vertical movement therebetween by placing pins in the lowest most position. Further, this invention allows the operator of the skid steer 10 to lift the V-shaped cutting blade 74 by tilting back the mounting plate 30 to use only the rear blades 76 and 77 for grading or back dragging. In like fashion, the V-shaped cutting blade 74 can be tilted forward and rear blades 76 and 77 lifted off the ground so that a ditch can be cut using the apex of the V-shaped cutting blade 74 as the operator travels forwards or backwards.

From the foregoing, it will be seen that this invention is one well adapted to attain all of the ends and objects hereinabove set forth, together with other advantages which are obvious or inherent to the apparatus. It will be understood that certain features and combinations are of utility and may be employed without reference to other features and combinations. This is contemplated by and is within the scope of the claims. As other possible embodiments may be made of the invention without departing from the scope thereof, it is to be understood that all matter set forth herein or shown in the accompanying drawings is to be interpreted as illustrative and not in a limiting sense.

Therefore, we claim:

1. A front mounted earth working apparatus for a skid steer, comprising:

a guide frame portion attached to the skid steer by a mounting mechanism, the guide frame portion having a lifting fork extending forward from said mounting mechanism, and the lifting fork being substantially horizontal with the ground;

a grading portion suspended below said guide frame portion from said lifting fork by a suspension mechanism, said grading portion being substantially parallel with said lifting fork, and said grading portion having a blade attached thereto; and the suspension mechanism having an attaching mechanism for pulling the grading portion as the skid steer moves forward so that the grading portion will lift without assistance under the lifting fork when the blade hits an unyielding obstruction.

2. The apparatus as defined in claim 1, wherein the suspension mechanism is a hinge and the attaching mechanism connects the hinge between the lifting fork and the grading portion.

3. The apparatus as defined in claim 1, wherein the mounting mechanism includes a mounting plate and there are at least two lifting forks extending from said mounting plate.

4. The apparatus as defined in claim 3, wherein the grading portion further comprises:

at least two side rails, each side rail being vertically aligned with one of the lifting forks in the guide frame portion, the blade attached to the grading portion being a nose blade attached below the side rails and at the front of the grading portion; and at least two rear blades attached below said side rails behind the nose blade, said rear blades being hinged for selective attachment to a corresponding adjustment plate so that the angle of each rear blade is adjustable.

5. The apparatus as defined in claim 3, wherein the grading portion further comprises:

at least two side rails with each side rail being vertically aligned with one of the lifting forks in the guide frame portion; and each side rail having front and back end guide brackets to confine the lateral movement of the grading portion with the guide frame portion.

6. The apparatus as defined in claim 5, wherein each side rail has a T-bracket which cooperates with the corresponding back guide bracket to prevent the guide frame portion and grading portion from separating vertically a distance sufficient to cause the suspension mechanism to buckle.

7. A front of the earth working apparatus for a vehicle, comprising:

a guide frame portion attached to the vehicle by a mounting mechanism, the guide frame portion including at least two lifting forks extending forward from the mounting mechanism and the lifting forks being substantially horizontal with the ground and parallel with each other;

a grading portion suspended below said guide frame portion by a suspension mechanism attached to said lifting forks, said grading portion being substantially parallel with said lifting forks;

the grading portion further comprising at least two side rails, each side rail being vertically aligned with one of the lifting forks, the suspension mechanism including a hinge connected between each lifting fork and the corresponding vertically aligned side rail; and a blade attached to said grading portion.

8. The apparatus as defined in claim 7, wherein the mounting mechanism includes a mounting plate.

9. The apparatus as defined in claim 7, further comprising at least two blades attached below said side rails, said blades being pivotally hinged at one end for selective attachment to a corresponding adjustment plate so that the angle of each blade is adjustable.

10. The apparatus as defined in claim 7, wherein each side rail having front and back end guide brackets to restrict the lateral movement of the grading portion with the guide frame portion.

11. The apparatus as defined in claim 10, wherein each side rail having a T-bracket which cooperates with the corresponding back end guide bracket to prevent the guide frame portion and grading portion from separating vertically a fixed distance thereby preventing the suspension mechanism from buckling.

12. A front mounted earth working apparatus for a skid steer, comprising:

a guide frame portion attached to the skid steer by a mounting mechanism, the guide frame portion having a lifting portion extending forward from said mounting mechanism;

a grading portion suspended below said guide frame portion by a suspension mechanism attached therebetween, and said grading portion having a blade attached thereto; and the suspension mechanism having an attaching mechanism for pulling the grading portion as the skid steer moves forward so that the grading portion will lift under the guide frame portion when the blade hits an unyielding obstruction.

13. The apparatus as defined in claim 12, wherein the mounting mechanism includes a mounting plate.

14. The apparatus as defined in claim 12, wherein the grading portion further comprising at least two side rails and two blades attached below said side rails, said blades being pivotally hinged at one end for selective attachment to a corresponding adjustment plate so that the angle of each blade is adjustable.

15. The apparatus as defined in claim 14, wherein each side rail having front and back end guide brackets to restrict the lateral movement of the grading portion with the guide frame portion.

16. The apparatus as defined in claim 15, wherein one of the side rails has a stop bracket which cooperates with one of the guide brackets mounted on the selected side rail so that the guide frame portion and grading portion are kept from separating vertically a fixed distance.

17. The apparatus as defined in claim 12, wherein the suspension mechanism comprises a hinge and the attaching mechanism attaches the hinge between the lifting portion and grading portion using a pivot pin.

18. The apparatus as defined in claim 17, wherein in the attaching mechanism, the pivot pin attaching the hinge to the grading portion is attached to a front end guide bracket of the grading portion, the front guide bracket having a plurality of hole positions for said front end guide bracket pin so that the hinge may be selectively attached thereto.

* * * * *